US007749363B2

(12) United States Patent
De Nora et al.

(10) Patent No.: US 7,749,363 B2
(45) Date of Patent: Jul. 6, 2010

(54) ALUMINIUM ELECTROWINNING CELL DESIGN WITH MOVABLE INSULATING COVER SECTIONS

(75) Inventors: Vittorio De Nora, Nassau (BS); Georges Berclaz, Veyras (CH)

(73) Assignee: Moltech Invent SA, Luxembourg (LU)

( * ) Notice: Subject to any disclaimer, the term of this patent is extended or adjusted under 35 U.S.C. 154(b) by 0 days.

(21) Appl. No.: 10/506,201

(22) PCT Filed: Jun. 3, 2003

(86) PCT No.: PCT/IB03/02360

§ 371 (c)(1),
(2), (4) Date: Aug. 31, 2004

(87) PCT Pub. No.: WO03/102274

PCT Pub. Date: Dec. 11, 2003

(65) Prior Publication Data

US 2005/0230265 A1 Oct. 20, 2005

(30) Foreign Application Priority Data

Jun. 4, 2002 (WO) ..... PCT/IB02/02018

(51) Int. Cl.
*C25C 3/08* (2006.01)

(52) U.S. Cl. ..... 204/247.4; 204/247.5; 204/243.1; 205/377; 205/378; 205/392

(58) Field of Classification Search ..... 204/247.4, 204/247.5, 243.1; 205/377, 378, 392
See application file for complete search history.

(56) References Cited

U.S. PATENT DOCUMENTS 6,402,928 B1 * 6/2002 de Nora et al. ..... 205/389

* cited by examiner

*Primary Examiner*—Bruce F. Bell
(74) *Attorney, Agent, or Firm*—Jayadeep R Deshmukh

(57) ABSTRACT

A cell for the electrowinning of aluminium by the electrolysis from an aluminium compound dissolved in a molten electrolyte (50), comprises: (I) a plurality of non-carbon anodes (10), each anode being suspended in operating in the molten electrolyte by an anode stem (11) that connects the anode (10) to a positive current source; and (II) a thermic insulating cover (60,60') which covers the electrolyte (50) and through which each anode stem (11) extends from the positive current source to an anode (10). The insulating cover (60,60') comprises a plurality of movable sections (60) that together cover a substantial part of the electrolyte (50). Each movable section (60) covers a corresponding portion of the electrolyte (50) that is located therebelow and that can be uncovered by moving the corresponding movable section (60). The anode stem (11) of each anode (10) extends through the insulating cover (60,60') between two movable sections (60) or between a movable section (60) and a fixed section (60') of the insulating cover (60,60') when the sections (60) are in a covering position over the electrolyte (50). Each movable section (60) is movable to uncover the corresponding electrolyte portion without interrupting operation of any anode (10), for example by tilting, in particular pivoting, or sliding and/or lifting the section (60).

33 Claims, 2 Drawing Sheets

ALUMINIUM ELECTROWINNING CELL DESIGN WITH MOVABLE INSULATING COVER SECTIONS

FIELD OF THE INVENTION

The invention relates to an aluminium electrowinning cell having non-carbon anodes in a molten electrolyte that is covered with a thermic insulating cover comprising movable cover sections and to the production of aluminium with such a cell.

BACKGROUND OF THE INVENTION

The technology for the production of aluminium by the electrolysis of alumina, dissolved in molten cryolite containing salts, at temperatures around 950° C. is more than one hundred years old.

Conventional aluminium production cells are constructed so that in operation a crust of solidified molten electrolyte forms around the inside of the cell sidewalls. At the top of the cell sidewalls, this crust is extended by a ledge of solidified electrolyte which projects inwards over the top of the molten electrolyte. The solid crust in fact extends over the top of the molten electrolyte between the carbon anodes. To replenish the molten electrolyte with alumina in order to compensate for depletion during electrolysis, this crust is broken periodically at selected locations by means of a crust breaker, fresh alumina being fed through the hole in the crust.

This crust/ledge of solidified electrolyte forms part of the cell's heat dissipation system in view of the need to keep the cell in operation at constant temperature despite changes in operating conditions, as when anodes are replaced, or due to damage/wear to the sidewalls, or due to over-heating or cooling as a result of great fluctuations in the operating conditions. In conventional cells, the crust is used as a means for automatically maintaining a satisfactory thermal balance, because the crust/ledge thickness self-adjusts to compensate for thermic unbalances. If the cell overheats, the crust dissolves partly thereby reducing the thermic insulation, so that more heat is dissipated through the sidewalls leading to cooling of the cell contents. On the other hand, if the cell cools, the crust thickens which increases the thermic insulation, so that less heat is dissipated, leading to heating of the cell contents.

The presence of a crust of solidified electrolyte is considered to be important to achieve satisfactory operation of commercial cells for the production of aluminium on a large scale. In fact, the heat balance is one of the major concerns of cell design and energy consumption, since only about 25% of such energy is used for the production of aluminium. Optimisation of the heat balance is needed to keep the proper bath temperature and heat flow to maintain a frozen electrolyte layer (side ledge) with a proper thickness.

In conventional cells, the major heat losses occur at the sidewalls, the current collector bars and the cathode bottom, which account for about 35%, 8% and 7% of the total heat losses respectively, and considerable attention is paid to providing a correct balance of these losses.

Further losses of 33% occur via the carbon anodes, 10% via the crust and 7% via the deck on the cell sides. This high loss via the anodes is considered inherent in providing the required thermal gradient through the anodes.

In the patent literature, there have been suggestions for cells operating without a crust of solidified electrolyte.

U.S. Pat. No. 5,368,702 (de Nora) discloses a multimonopolar aluminium production cell operating with tubular anodes in a crustless molten electrolyte which is thermally insulated by a cover. The cover is lined underneath with a layer of thermally insulating material. U.S. Pat. No. 5,415,742 (La Camera/Tomaswick/Ray/Ziegler) discloses another aluminium production cell operating with a crustless molten electrolyte which is thermally insulated by a cover.

WO02/06565 (D'Astolfo/Hornack), U.S. publications 2001/0035344 (D'Astolfo/Lazzaro) and 2001/0037946 (D'Astolfo/Moor) disclose an aluminium production cell having thermally insulating cover sections over the cell's electrolyte and several inert anode blocks that are suspended from each cover section, the cover sections serving also to distribute current to the inert anode blocks connected thereto.

U.S. Pat. No. 6,402,928 (de Nora/Sekhar) discloses an aluminium production cell having an insulating cover made of sections associated with individual anodes or groups of anodes, the insulating cover being removable by sections so that the individual anodes or groups of anodes can be separately replaced or serviced by removing only the removable sections associated therewith.

Despite previous efforts to develop a cell design for operation with non-carbon anodes, there is still a need to provide an aluminium production cell with an insulating cell cover permitting simplified cell operation.

SUMMARY OF THE INVENTION

The invention relates to a cell for the electrowinning of aluminium from an aluminium compound dissolved in a molten electrolyte, in particular by the electrolysis of alumina dissolved in a fluoride-based molten electrolyte. The cell comprises: (I) a plurality of individual non-carbon anodes or a plurality of groups of non-carbon anodes, each individual anode or group of anodes being suspended in operation in the molten electrolyte by an anode stem that connects the individual anode or the group of anodes to a positive current source; and (II) a thermic insulating cover which covers the electrolyte and through which each anode stem extends from the positive current source to an individual anode or a group of anodes. The insulating cover comprises a plurality of movable sections that, together, cover a substantial part of the electrolyte. Each movable section covers a corresponding portion of the electrolyte that is located therebelow and that can be uncovered by moving the corresponding movable section.

According to the invention the anode stem of each individual anode or group of anodes extends through the insulating cover between two movable sections or between a movable section and a fixed section of the insulating cover when said sections are side-by-side in a covering position over the electrolyte. Each movable section is movable to uncover the corresponding electrolyte portion without interrupting operation of any individual anode or group of anodes.

Unlike prior art removable cover sections, the movable cover section of the present invention can be moved away from its covering position over the molten electrolyte without having to interrupt operation of any anode, i.e. while maintaining supply into the electrolyte of an electrolysis current from each anode (or each group of anodes) to electrolyse the aluminium compound dissolved in the electrolyte. In particular it is not necessary to disconnect the anodes or move the anodes out of an operating location while covering or uncovering portions of the molten electrolyte.

It follows that the entire electrolyte surface or at least a significant portion thereof can be accessed during use without significantly interfering with the electrolysis process. In this context a significant portion usually corresponds to more than a third, typically at least half, preferably no less than two thirds and even more preferably at least three quarter of the electrolyte surface. However, to minimise heat loss during operation when a portion of the electrolyte needs to be accessed, only the movable cover section(s), that is/are usually located more or less vertically above this electrolyte portion, should be moved away from its/their covering position.

The insulating cell cover can be made of any material, e.g. ceramic, resistant to high temperature oxidising/corrosive environment, in particular to an oxygen and fluoride containing atmosphere. For example, the cover is made of a composite material disclosed in WO02/070784 (de Nora/Berclaz).

Preferably, each movable section is individually movable to uncover only the corresponding electrolyte portion so as to minimise heat loss as far as possible.

Each individual anode or group of anodes can be associated with at least one movable cover section, usually one, two, three or four movable sections, and is replaceable or serviceable by moving only the movable section(s) associated therewith.

At least one movable cover section can be associated with a plurality of individual anodes or groups of anodes. For example one movable cover section is associated with a plurality of anodes that are located adjacent one edge and/or adjacent neighbouring edges and/or opposite edges of the movable cover section.

Usually, each individual anode or each group of anodes extends under the insulating cover sidewards from a bottom end of the anode stem by which it is suspended. Examples of such anodes are disclosed in U.S. Pat. No. 6,358,393 (Berclaz/de Nora) and U.S. Pat. No. 6,540,887 (de Nora), and in WO99/02764 (de Nora/Duruz), WO00/40781, (de Nora), WO01/31086 (de Nora/Duruz), WO03/006716 and WO03/023092 (both de Nora). Alternatively, the anodes can be horizontally confined under the anode stems, for example as disclosed in U.S. Pat. No. 5,368,702 (de Nora) and WO01/31088 (de Nora).

The anode can be an oxygen-evolving ceramic, cermet or metal-based anode. In particular, the anode can be made of any of the materials disclosed in WO00/06802, WO00/06803 (both in the name of Duruz/de Nora/Crottaz), WO00/06804 (Crottaz/Duruz), WO01/42535 (Duruz/de Nora), WO01/42534 (de Nora/Duruz), WO01/42536 (Duruz/Nguyen/de Nora), WO02/083991 (Nguyen/de Nora), WO03/014420 (Nguyen/Duruz/de Nora) and PCT/IB03/00964 (Nguyen/de Nora). Further oxygen-evolving anode materials are disclosed in WO99/36593, WO99/36594, WO00/06801, WO00/06805, WO00/40783 (all in the name of de Nora/Duruz), WO00/06800 (Duruz/de Nora), WO99/36591, WO99/36592 (both in the name of de Nora) and PCT/IB03/01479 (Nguyen/de Nora). Oxygen-evolving anodes may be coated with a protective layer made of one or more cerium compounds, in particular cerium oxyfluoride, as disclosed in WO02/070786 (Nguyen/de Nora), WO02/0083990 (de Nora/Nguyen), and in U.S. Pat. No. 4,614,569 (Duruz/Derivaz/Debely/Adorian), U.S. Pat. No. 4,680,094 (Duruz), U.S. Pat. No. 4,683,037 (Duruz) and U.S. Pat. No. 4,966,674 (Bannochie/Sheriff).

The insulating cover may comprise a plurality of movable cover sections placed side-by-side, in particular side-by-side along the cell. An anode stem can extend through the cell cover between two side-by-side movable cover sections.

The insulating cover may comprise a plurality of movable cover sections placed end-to-end, in particular end-to-end across the cell. An anode stem can extend through the cell cover between two end-to-end movable cover sections.

The insulating cover may comprise a fixed cover section and a movable cover section adjacent thereto over the electrolyte. For example, the insulating cover comprises a central fixed cover section extending along the cell and one or more movable cover sections on each side of the central cover section and over the electrolyte. An anode stem can extend through the cell cover between the fixed cover section and the movable cover section.

A movable cover section can be pivotally mounted along a horizontal axis in particular adjacent to and generally along an upper part of a cell sidewall, so that the movable section can be pivoted from and back into its covering position. To facilitate pivoting of the movable section, the section can be associated with a counterweight located beyond the pivoting axis opposite the section.

A movable cover section can also be separable from the cell during operation.

A movable cover section can rest on a cell sidewall and/or on a fixed cover section or may be suspended over the electrolyte by suspension means, such as wires or chains. Conveniently, the suspension means is connected to a drive means, such as an electric motor, or to a counterweight to move or assist movements of the movable section.

Preferably, a movable cover section comprises a gripping means, such as a handle or a ring, for moving or assisting movements of the section manually (by hand), in particular using a crowbar, or an attachment means, such as a hook or ring, for moving or assisting movements of the section with a lifting device, such as a crane.

Usually, the cell of the invention, in particular when in a drained configuration, has an arrangement for accumulating product aluminium above which a movable cover section is arranged to be intermittently moved away from its covering position for allowing access of an aluminium tapping device to this arrangement. Suitable aluminium accumulation arrangements are disclosed in WO00/63463, WO02/097169 (de Nora) or WO02/097168 (all de Nora). This movable cover section can be associated with one or more anodes or can be a separate movable cover section.

When required by the configuration of the alumina feeder, the insulating cover comprises at least one opening for feeding an aluminium compound to the molten electrolyte. Such alumina feeders can be conventional point feeders or feeders that are arranged to spray/spread alumina over the molten electrolyte, for example as disclosed in WO00/63464 (de Nora/Berclaz) and WO03/006717 (Berclaz/Duruz). If the alumina feeder is not permanently in the aluminium feeding opening, this opening can be fitted with a movable closure member for reducing heat loss while the feeder is not in the opening.

The invention also relates to a method of electrowinning aluminium in a cell as described above. The method comprises electrolysing an aluminium compound between the individual anodes or the groups of anodes and a cathode to produce gas anodically and produce aluminium cathodically, maximising the covering of the electrolyte to maintain the electrolyte substantially thermally insulated and inhibit formation of an electrolyte crust on at least part of the electrolyte, and feeding an aluminium compound to this part of the electrolyte for replenishing the aluminium compound consumed during electrolysis.

Typically, the covering of the electrolyte is maximised by moving away from its/their covering position only the movable cover section(s) (vertically) above a portion of the electrolyte that needs to be accessed and only for the time required for the access.

Aluminium can be accumulated below a movable cover section and intermittently extracted from the cell by: moving the movable cover section that covers the accumulated aluminium away from its covering position; introducing from outside the cell a tapping device into the accumulated aluminium; tapping the accumulated aluminium; extracting the tapping device from the cell; and moving the movable cover section back into its covering position.

As discussed above, a movable cover section can be mounted in different ways. During cell operating the movable section can be tilted, in particular pivoted, slided and/or lifted to move it away from its covering position.

An aluminium compound, in particular alumina, can be fed to the electrolyte through at least one opening in the insulating cover.

The cell can be operated with a deep pool of aluminium. Preferably the cell is operated with a shallow layer of aluminium or in a drained configuration. Preferably, the cathode, and possibly other parts of the cell, are covered with an aluminium-wettable material, for example as disclosed in WO01/42168 (de Nora/Duruz), WO01/42531 (Nguyen/Duruz/de Nora), WO02/070783, WO02/070785 (both de Nora), WO02/096830 (Duruz/Nguyen/de Nora), WO02/096831 (Nguyen/de Nora), WO02/097168 and WO02/097169 (both de Nora).

BRIEF DESCRIPTION OF THE DRAWINGS

Embodiments of the invention will now be described by way of example with reference to the accompanying schematic drawings, wherein.

DETAILED DESCRIPTION

Figure 1:
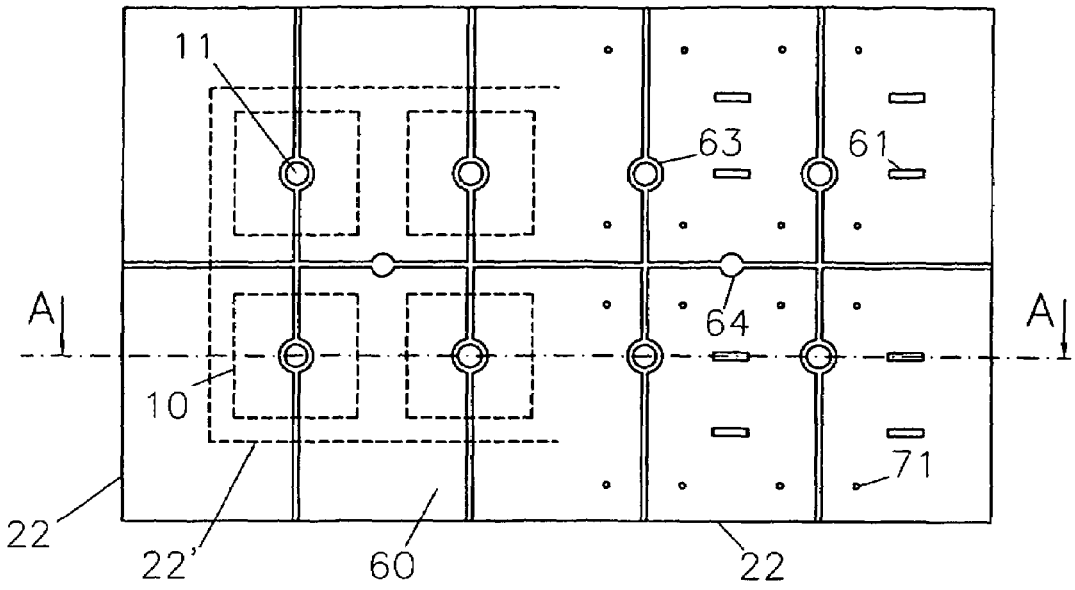
FIGS. 1 and 2 schematically show respectively a plan view and a cross-sectional view of an aluminium electrowinning cell having non-carbon anodes and an insulating cover according to the invention.
Figure 2:
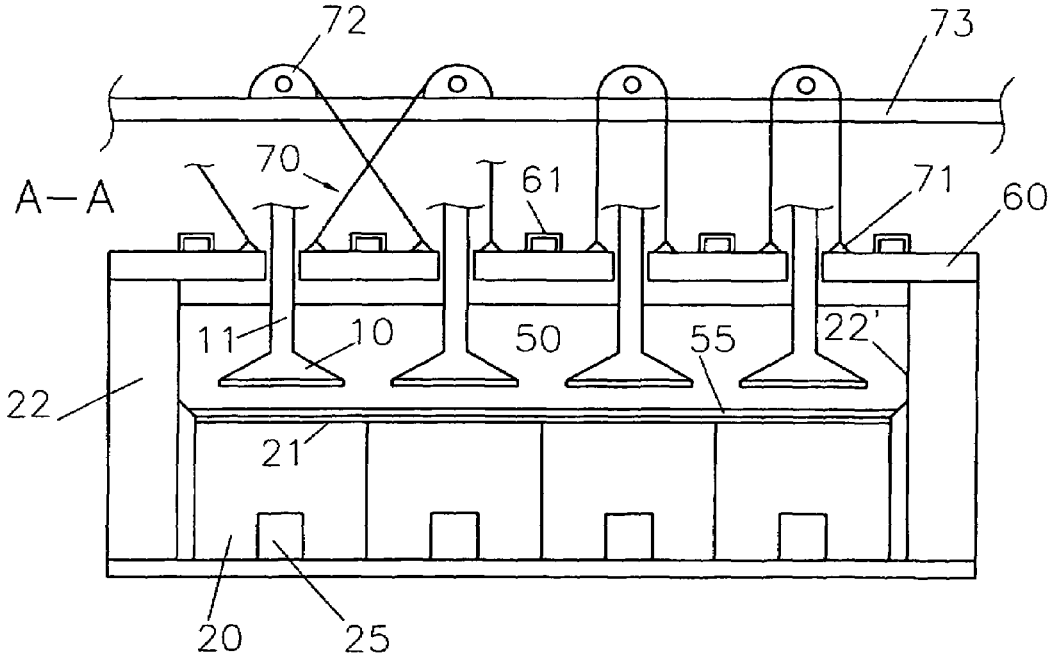

FIGS. 1 and 2 illustrate an aluminium electrowinning cell having a series of anodes 10 (shown in dotted lines on the left-hand side of FIG. 1) connected to a positive current source and suspended over a cathode bottom 20 by anode stems 11. The cathode bottom 20 is made of side-by-side carbon blocks covered with an aluminium-wettable coating 21 and product aluminium 55 and connected to a negative bus bar through steel bars 25 that extend along the cathode blocks.

The cathode can be covered with a shallow pool of molten aluminium (not shown) or with a thin layer of aluminium 55 as shown in FIG. 2, the cathode bottom 20 being in a drained configuration in which case the cell bottom should be provided with an aluminium collection reservoir, for instance as disclosed in the abovementioned references.

The anodes 10 are immersed in a molten fluoride-based electrolyte 50 covered by an insulating cover that is made of movable sections 60 arranged side-by-side along the cell and in pairs end-to-end across the cell. The anode rods 11 extend through the insulating cover between side-by-side sections 60 which have cut-outs 63 that fit around the anode stems 11. Vertical passages 64 for feeding alumina are formed by facing cut-outs between pairs of movable sections 60 across the cell.

The movable cover sections 60 rest on cell sidewalls 22 whose inner faces 22' are shown in dotted lines on the left-hand side of FIG. 1. The cover sections 60 are suspended over the electrolyte 50 by wires 70 which are attached at one end to fasteners 71 on the sections 60 and which lead to electric motors 72 or other drive means secured on horizontal support beams 73 that extend longitudinally over the cell. On the right-hand side of FIG. 2, each wire 70 extends from adjacent one edge of cover section 60 to a motor 72 placed substantially vertically above that edge, whereas on the left-hand side of FIG. 2, each wire 70 extends from adjacent one edge of cover section 60 to a motor 72 located substantially vertically above an opposite edge of cover section 60 so that the wires 70 are in an X configuration facilitating the tilting of the cover section 60 by using motor 72.

Furthermore, the movable cover sections 60 are fitted with handles 61 for manually moving them or, if they are moved using motors 72, for manually assisting guiding of the sections during motion.

The anodes 10 have an active structure, e.g. a grid-like or plate-like structure as disclosed in the abovementioned references, that extends sideways under the movable cover sections 60. Alternatively, the anodes could be tubular without extending sideways under the movable cover sections as mentioned above.

The non-carbon anodes 10 as well as the anode stem 11 can be made of a conductive ceramic, cermet or metal-based material resistant to the molten electrolyte. Advantageously, the anodes 10 and the stems 11 are made of an iron-based alloy containing for example nickel as discussed above.

During operation of the cell shown in FIGS. 1 and 2 alumina dissolved in the molten electrolyte 50 is electrolysed between the non-carbon anodes 10 and the cathode bottom 20 to evolve gas anodically and aluminium 55 cathodically. Fresh alumina is fed continuously or intermittently through passages 64 to replenish the electrolyte 50. Alumina can be fed using conventional point feeders or alumina sprayers as mentioned above.

An anode 10 can be individually serviced or replaced by moving the two corresponding movable cover sections 60 located thereabove. The two movable sections 60 surrounding the anode stem 11 of the anode 10 are tilted generally around their longest edge opposite that receiving anode stem 11, preferably using the electric motors 72 and/or handles 61, and placed against the neighbouring anode stems 11 adjacent the anode 10 that needs to be accessed. The corresponding anode 10 can then be extracted from the electrolyte 50.

Unlike the cells disclosed in the abovementioned U.S. Pat. No. 6,402,928, one anode 10 of the cell according to the invention can be extracted from the cell and the anode's corresponding cover sections 60 can be put back into their covering positions with a different anode inserted in the cell or, temporarily, even without any anode at all, for example to avoid heat loss while the extracted anode undergoes a quick examination and/or a servicing procedure and is then put back into the cell without anode substitution.

For tapping accumulated aluminium 55, a movable cover section 60 is moved away from its covering position, a tapping device is introduced from outside the cell into the accumulated aluminium 55, and the accumulated aluminium 55 is tapped. Thereafter, the tapping device is extracted from the cell and the movable cover section 60 is moved back into its covering position.

Figure 3:
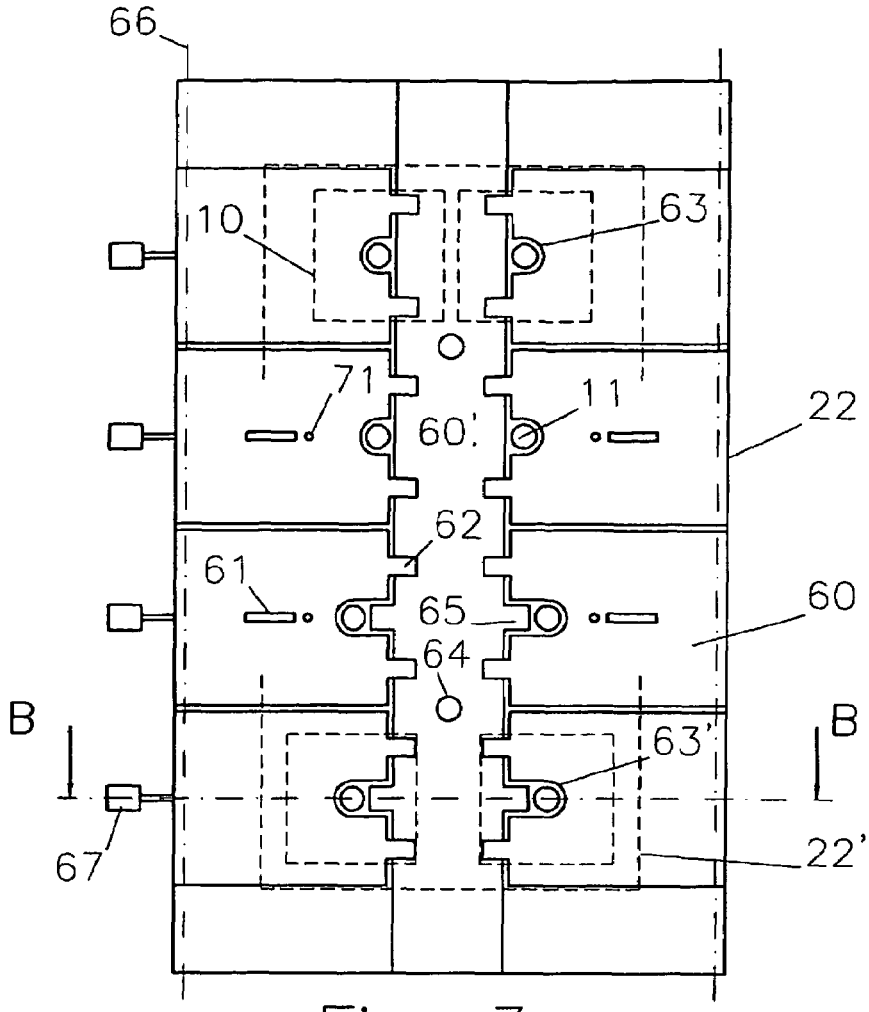
FIGS. 3 and 4 schematically show respectively a plan view and a cross-sectional view of another aluminium electrowinning cell having non-carbon anodes and an insulating cover according to the invention.
Figure 4:
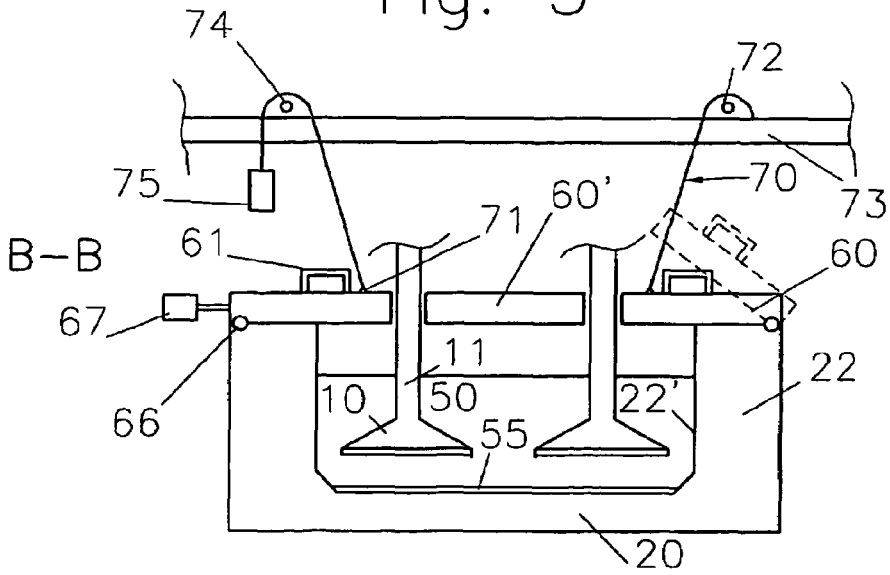

FIGS. 3 and 4 schematically show another cell according to the invention. The cell has a series of anodes 10 (shown in dotted lines in the upper part and in the lower part of FIG. 3) connected to a positive current source and suspended over a cathode bottom 20 by anode stems 11.

The anodes 10 are immersed in a molten fluoride-based electrolyte 50 covered by an insulating cover 60, 60' made of a central fixed cover section 60' and movable sections 60 placed on each side of fixed section 60' and arranged side-by-side along the cell.

Each anode stem 11 extends through the insulating cover 60, 60' between fixed section 60' and a movable section 60 shown tilted in dotted lines on the right-hand side of FIG. 4, it being understood that the movable section 60 can be pivoted to about a vertical position. The movable sections 60 have cut-outs 63, 63' that fit around the anode stems 11. As shown on the upper part of FIG. 3, the cut-outs 63 extend into movable sections 60 so as to accommodate only the anode stems 11, whereas on the lower part of FIG. 3, the cut-outs 63' extend farther into the movable sections 60 so as to accommodate the anode stems 11 as well as protrusions 65 of fixed section 60'. In the latter case, the anode stems 11 have a greater spacing across the cell between them. This permits optimised use of the surface of the cathode bottom 20 and/or use of larger anodes and/or utilisation of a central channel (not shown) for collecting product aluminium 55, as mentioned above.

In a variation, the fixed cover sections are fitted with cut-outs that fit around the anode stems (not shown). Likewise, a cut-out can accommodate only an anode stem or an anode stem plus a protrusion of the movable cover sections.

The movable cover sections 60 are pivotally mounted along a horizontal axis 66 adjacent to and along an upper part of longitudinal cell sidewalls 22, the inner faces 22' of the sidewalls being indicated in dotted lines in the upper part and in the lower part of FIG. 3, and are fitted with handles 61, like the movable cover sections 60 of FIGS. 1 and 2. On the left-hand side of FIGS. 3 and 4, the movable cover sections 60 are connected to a schematically shown counterweight 67 located beyond the pivoting axis 66 opposite the movable sections 60 for assisting lifting the sections 60.

The cover sections 60 have protrusions 62 that rest on fixed section 60' and are suspended over the electrolyte 50 by wires 70 through fasteners 71.

As shown on the right-hand side of FIG. 4, the wires are connected to electric motors 72 or other drive means secured on a horizontal support beams 73 that extend over and across the cell. In the left-hand side of FIG. 4, the wires 70 extend over pulleys 74 mounted on beam 73 and are connected to another counterweight 75 for assisting the lifting of movable cover section 60. Each movable cover section can be associated with a drive means as well as one or more counterweights.

During operation of the cell shown in FIGS. 3 and 4 alumina dissolved in the molten electrolyte 50 is electrolysed between the non-carbon anodes 10 and the cathode bottom 20 to evolve gas anodically and aluminium 55 cathodically. Fresh alumina is fed continuously or intermittently through passages 64 to replenish the electrolyte 50.

An anode 10 can be individually serviced or replaced by removing the corresponding movable cover section 60 located thereabove. The movable section 60 surrounding the anode stem 11 of the anode 10 can be pivoted automatically using motor 72 or manually using handle 61. The corresponding anode 10 can then be extracted from the electrolyte 50.

For tapping accumulated aluminium 55, a movable cover section 60 is moved away from its covering position, a tapping device is introduced from outside the cell into the accumulated aluminium, and the accumulated aluminium is tapped. Thereafter, the tapping device is extracted from the cell and the movable cover section 60 is moved back into its covering position.

In a variation, the insulating cell cover, in particular a fixed cover section thereof, can be fitted with an additional smaller opening specifically designed for allowing passage of an aluminium tapping device. This additional opening is preferably covered with a corresponding movable closure when no aluminium is tapped to avoid heat loss.

The invention claimed is:

1. A cell for the electrowinning of aluminium from an aluminium compound dissolved in a molten electrolyte, in particular by the electrolysis of alumina dissolved in a fluoride-based molten electrolyte, comprising:—a plurality of individual non-carbon anodes or a plurality of groups of non-carbon anodes, each individual anode or group of anodes being suspended in operation in the molten electrolyte by an anode stem that connects the individual anode or the group of anodes to a positive current source; and—a thermic insulating cover which covers the electrolyte and through which each anode stem extends from the positive current source to an individual anode or a group of anodes, the insulating cover comprising a plurality of movable sections that together cover a substantial part of the electrolyte, each movable section covering a corresponding portion of the electrolyte that is located therebelow and that can be uncovered by moving the corresponding movable section, characterised in that the anode stem of each individual anode or group of anodes extends through the insulating cover between two movable sections or between a movable section and a fixed section of the insulating cover when said sections are in a covering position over the electrolyte, each movable section being movable to uncover the corresponding electrolyte portion without interrupting operation of any individual anode or any group of anodes.

2. The cell of claim 1, wherein each movable section is individually movable to uncover only the corresponding electrolyte portion.

3. The cell of claim 1, wherein each individual anode or group of anodes is associated with at least one movable cover section and is replaceable or serviceable by moving only the movable section(s) associated therewith.

4. The cell of claim 3, wherein at least one movable cover section is associated with a plurality of individual anodes or groups of anodes.

5. The cell of claim 1, wherein each individual anode or each group of anodes extends under the insulating cover sidewards from a bottom end of the anode stem by which it is suspended.

6. The cell of claim 1, wherein the insulating cover comprises a plurality of movable cover sections placed side-by-side.

7. The cell of claim 6, wherein the insulating cover comprises a plurality of movable cover sections placed side-by-side along the cell.

8. The cell of claim 6, wherein an anode stem extends through the cell cover between two side-by-side movable cover sections.

9. The cell of claim 1, wherein the insulating cover comprises a plurality of movable cover sections placed end-to-end.

10. The cell of claim 9, wherein the insulating cover comprises a pair of movable cover sections that are placed end-to-end across the cell.

11. The cell of claim 9, wherein an anode stem extends through the cell cover between two end-to-end movable cover sections.

12. The cell of claim 1, wherein the insulating cover comprises a fixed cover section and a movable cover section adjacent thereto over the electrolyte.

13. The cell of claim 12, wherein the insulating cover comprises a central fixed cover section extending along the cell and a movable cover section on each side of the central cover section over the electrolyte.

14. The cell of claim 12, wherein an anode stem extends through the cell cover between the fixed cover section and the movable cover section.

15. The cell of claim 1, wherein a movable cover section is detachable from the cell during operation.

16. The cell of claim 1, wherein a movable cover section is arranged to be slid and/or lifted to uncover a portion of the electrolyte.

17. The cell of claim 1, wherein a movable cover section is arranged to be tilted, in particular pivoted, to uncover a portion of the electrolyte.

18. The cell of claim 17, wherein said movable cover section is pivotally mounted along a horizontal axis.

19. The cell of claim 1, wherein a movable cover section rests on a cell sidewall.

20. The cell of claim 1, comprising a fixed cover section and a movable cover section resting thereon.

21. The cell of claim 1, comprising a means for suspending a movable cover section over the electrolyte.

22. The cell of claim 21, wherein the suspending means is connected to a drive means to move or assist movements of the movable cover section.

23. The cell of claim 1, wherein a movable cover section comprises a gripping means for moving or assisting movements of the section manually.

24. The cell of claim 1, wherein a movable cover section comprises an attachment means for moving or assisting movements of the section with a lifting device attachable thereto.

25. The cell of claim 1, comprising an arrangement for accumulating product aluminium above which a movable cover section is arranged to be intermittently moved away from its covering position for allowing access of an aluminium tapping device to said arrangement.

26. The cell of claim 1, wherein the insulating cover comprises at least one opening for feeding an aluminium compound to the molten electrolyte.

27. A method of electrowinning aluminium in a cell as defined in claim 1, comprising electrolysing an aluminium compound between the individual anodes or the groups of anodes and a cathode to produce gas anodically and aluminium cathodically, maximising the covering of the electrolyte to maintain the electrolyte substantially thermally insulated and inhibit formation of an electrolyte crust on at least part of the electrolyte, and feeding an aluminium compound to said part of the electrolyte for replenishing the aluminium compound consumed during electrolysis.

28. The method of claim 27, wherein, to replace or service an individual anode or a group of anodes suspended by an anode stem, only the movable section(s) associated with the anode stem is moved.

29. The method of claim 27, comprising uncovering a portion of the electrolyte by moving only the corresponding movable section.

30. The method of claim 29, comprising accumulating aluminium below a movable cover section and intermittently extracting accumulated aluminium from the cell by: moving the movable cover section that covers the accumulated aluminium away from its covering position; introducing from outside the cell a tapping device into the accumulated aluminium; tapping the accumulated aluminium; extracting the tapping device from the cell; and moving the movable cover section back into its covering position.

31. The method of claim 30, wherein a portion of the electrolyte is uncovered by tilting, in particular pivoting, a movable cover section.

32. The method of claim 31, wherein a portion of the electrolyte is uncovered by sliding and/or lifting a movable cover section.

33. The method of claim 32, comprising feeding the aluminium compound to the electrolyte through at least one opening in the insulating cover.

* * * * *